US011020863B1

(12) United States Patent
Demko

(10) Patent No.: US 11,020,863 B1
(45) Date of Patent: Jun. 1, 2021

(54) LOCKING DEVICE FOR A FOLDING KNIFE

(71) Applicant: Andrew Demko, Wampum, PA (US)

(72) Inventor: Andrew Demko, Wampum, PA (US)

( * ) Notice: Subject to any disclaimer, the term of this patent is extended or adjusted under 35 U.S.C. 154(b) by 0 days.

(21) Appl. No.: 16/865,680

(22) Filed: May 4, 2020

(51) Int. Cl.
*B26B 1/04* (2006.01)

(52) U.S. Cl.
CPC ..... *B26B 1/042* (2013.01)

(58) Field of Classification Search
CPC .. B26B 1/042; B26B 1/00; B26B 1/02; B26B 1/04; B26B 1/048
USPC ..... 30/161, 153, 155, 158, 160, 337
See application file for complete search history.

(56) References Cited

U.S. PATENT DOCUMENTS 4,442,600 A * 4/1984 Felix-Dalichow ..... B26B 1/042 30/161
4,535,539 A * 8/1985 Friedman ..... B26B 1/046 30/159
5,093,995 A 3/1992 Jan
5,685,079 A 11/1997 Brothers et al.
6,574,869 B1 6/2003 McHenry et al.
6,751,868 B2 6/2004 Glesser
6,918,184 B2 7/2005 Glesser
7,222,429 B2 * 5/2007 PerMar, Jr. ..... B26B 1/042 30/155
7,469,476 B2 12/2008 Demko
2017/0136634 A1 * 5/2017 Kao ..... B26B 1/042

* cited by examiner

*Primary Examiner* — Phong H Nguyen
(74) *Attorney, Agent, or Firm* — Harpman & Harpman

(57) ABSTRACT

A folding knife having an improved locking mechanism that keeps the knife in open extended use position until specific close actions are initiated. The improved locking mechanism provides a safety pin that is secured within the frame element so as to be positioned between the knife blade and the free end of the locking bar that is spring urged there against imparting movement force transfer locking structure thereto with wear adjustable pivot engagement points of locking mechanism under spring urged locking engagement.

10 Claims, 4 Drawing Sheets

LOCKING DEVICE FOR A FOLDING KNIFE

BACKGROUND OF THE INVENTION

1. Technical Field

This invention relates to folding knives that provide a compact configuration in which the knife blade is pivotally attached to the handle and can be folded there within when not in use. Such folding knives have blade engagement locking devices to secure, lock and hold the blade in extended longitudinal position with the handle for use. A typical locking element is commonly referred to as a lock bar that extends the upper back edge of the knife and requires a manual depression at one end to release the free end from direct engagement within a retaining lock notch formed in the blade inwardly of its primary pivot attachment point with the handle frame elements.

2. Description of Prior Art

Prior art folding knives of this type have a variety of blade locking engagement structures to afford a number of blade lock and release positions, see for example U.S. Pat. Nos. 5,093,995, 5,685,079, 6,574,869, 6,751,868, 6,918,184, 7,222,429 and 7,469,476.

In U.S. Pat. No. 5,093,995 a knife locking mechanism is disclosed that uses a preassembled lock pin having a notch therein to be resiliently engaged with a corresponding notch in the blade locking same in extended use position.

U.S. Pat. No. 5,685,079 claims a locking mechanism for a folding knife in which a lever is movable between two positions using a notch cylinder body to selectively engage a portion of the blade.

U.S. Pat. No. 6,574,869 is directed to a folding pocket knife with lock having a locking pin that is slidably positioned to engage a shoulder on the blade.

U.S. Pat. No. 6,918,184 discloses a knife with an integral stop pin of a locking mechanism is used to prevent an inadvertent closing of the knife blade as well as over extension of the blade during use.

U.S. Pat. No. 6,751,868 shows a folding knife with a spherical locking mechanism is illustrated having a ball biased by a coil spring. The ball selectively engages a tongue portion of the heal of the blade preventing the blade from rotation locking same.

U.S. Pat. No. 7,222,429 discloses a folding knife with a locking pin engagement with a locking bar. The locking pin in one form is tapered so as to provide adjustable diameter pin surface that engages the locking bar partially there against.

Applicant's U.S. Pat. No. 7,469,476 discloses an improvement to a folding knife locking reinforcement wherein an improved safety pin is disclosed with an elongated bar pivot point opening and an extended locking bar free end portion that overrides the pin.

SUMMARY OF THE INVENTION

An improved locking reinforcement mechanism for a folding knife utilizing a contoured reinforcement pin that transfers load pressures from the lock pivot pin of the locking bar and an enhanced locking bar pivot position by both longitudinal and vertical bar displacement under activation obviating knife lock failure and maintaining operational use and safety.

DETAILED DESCRIPTION OF THE INVENTION

Figure 1:
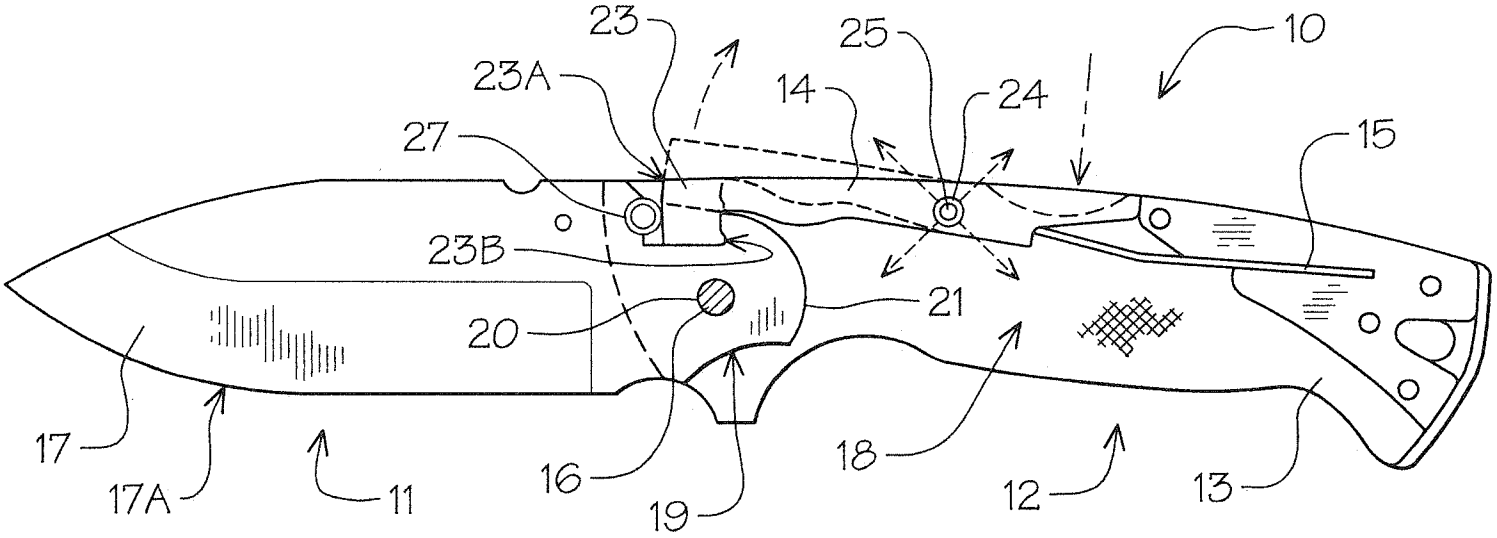
FIG. 1 is a side elevational view of the folding knife with portions broken away in opened locked position with reinforcing pin and locking bar of the invention.

Referring to FIG. 1 of the drawings, a folding knife 10 of the invention can be seen in unfolded locked position. The knife 10 has a blade portion 11 pivotally secured to a handle support portion 12. The handle support portion 12 has a frame member 13 with a pivoted locking bar 14 and independent spring element 15 extending from the handle support portion 12 for engagement therewith. The blade portion 11 is pivotally secured via a hinge pin 16 therethrough as that which is manually deployed for a folding knife configuration.

The blade portion 11 defines a blade 17 which is removably disposed within a blade retention slot 18 defined within the handle support 12 so that the sharpened edge 17A of the blade 17 is safely enclosed therewithin. The blade 17 has a shank portion 19 apertured at 20 through which the blade hinge pin 16 extends. The shank portion 19 has an arcuate end edge 21 that defines at its upper terminus a shank hook 22 formed within.

Figure 2:
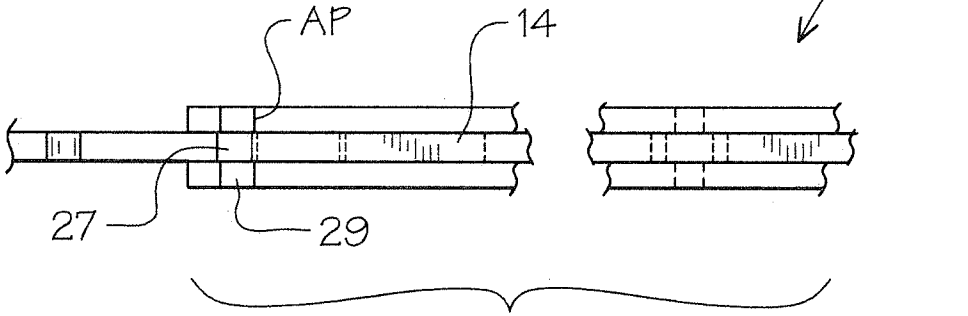
FIG. 2 is an enlarged partial top plan view with portions broken away of the reinforcing pin and repositional pivot position of the locking bar.

The locking bar 14 has a corresponding engageable notched end portion 23 with a contoured angle surface 23A and a corresponding contoured angle notched surface 23B that is registerably engaged with the shank hook 22 when in folded open locked portion. The pivoting lock bar 14 has an enlarged preferably annual shaped pivot pin receiving opening at 24 for a bar lock pivot pin 25, best seen in FIGS. 1, 2 and 8 of the drawings. It will be seen that the orientation of the locking bar pivot pin 25 within the enlarged opening 24 during bar activation shown in broken lines in FIG. 1 and solid lines in FIG. 8 of the drawings provides for an adjustable repositioning of a pivot point thereby a true adjustable pivot point PP is achieved for the locking bar 14. It will be seen that the adjustable pivot point PP will in turn provide and accommodate for user wear and for manufacturing variations inherent in such knife use and manufacturing which effects both its longevity and vertical angular orientation. This adaptable repositioning of the pivot point PP generally indicated by broken directional arrows P in FIGS. 1 and 8 of the drawings assures proper locking bar safety repositioned pin and shank hook engagement during operational open lock and release parameters.

The spring element 15 as seen extending from the frame 13 is engaged on the locking bar 14 portion in spaced longitudinal relation to the pivot pin 25 bar engagement providing spring urged return action to the locking bar during use.

Referring now to FIGS. 1 and 5-7 of the drawings, a modified improved safety reinforcement pin 27 of the invention can be seen having a main cylinder body portion 28 with integral monolithic oppositely disposed axially aligned cylindrical mounting lugs 29A and 29B of reduced diameter extending respectively therefrom. The mounting lugs 29A and 29B are correspondingly registerable in spaced opposing mounting apertures AP in the real frame elements 13, best indicated and seen in FIG. 2 of the drawings.

Figure 7:
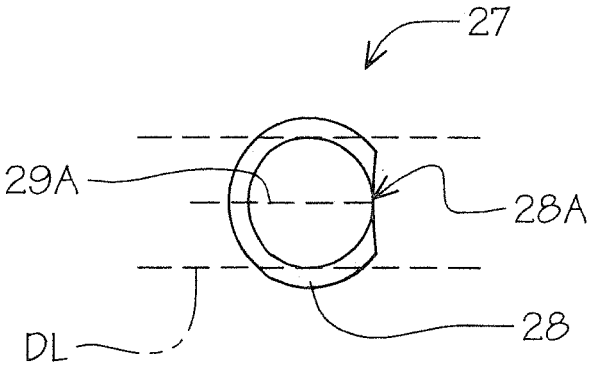
FIG. 7 is an enlarged end elevational view on lines 7-7 of FIG. 5.

The main cylinder body portion 28 has a contoured relief portion 28A formed therein extending laterally a distance equal to the corresponding reduced transverse diameter of the hereinbefore described mounting lugs 29A and 29B indicated graphically by broken dimensional equivalent lines DL in FIG. 7 of the drawings.

Referring to FIG. 1 of the drawings, it will be seen that the locking bar contoured end surface 23A will registerably engage the safety reinforcement relief surface 28A. Correspondingly, the engagement surfaces 23A and 23B of the locking bar are both of a co-parallel arcuate angular inclination as illustrated effecting a positive engagement between the safety reinforcement pin 27 and the blade's shank hook 22. The safety reinforcement pin 27 is used therefore to transfer load input indicated by directional arrows to the lock bar fixed pivot pin 25 within the lock bar receiving opening 24.

Figure 8:
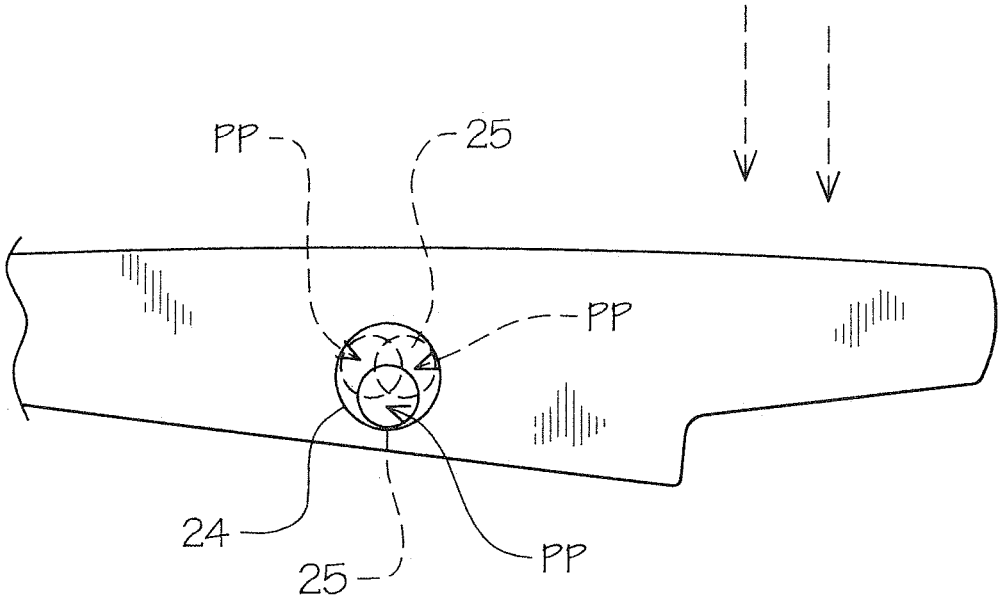
FIG. 8 is an enlarged partial side elevational view of the improved locking bar and pivot pin readjustable positions therein shown in broken lines.

It will be seen as such that under operational user input, the lock bar will move about the fixed pivot pin 25 from a bottom center position creating an effective alternate pivot point location indicated graphically in FIG. 8 of the drawings. This re-orientation of the effective lock bar pivot point PP provides release from the under-cut engagement of the shank hook engaged surface 22.

It will also be seen that the corresponding engagement of the lock bar engagement surface 23A with the safety reinforcement pins main cylinder body's relief contoured surface 28A affords a more positive engagement when in locked position. This combination assures that the locking mechanism won't jam or be difficult to use with improved locking and unlocking prerequisites despite variations in manufacturing tolerances and extended use wear which occurs in such products.

Figure 3:
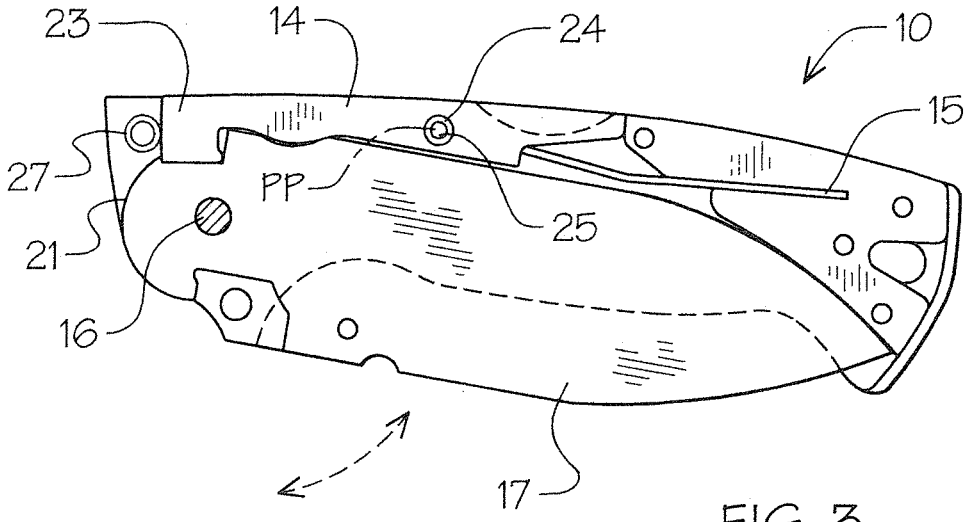
FIG. 3 is a side elevational view with portions broken away of the folding knife in full closed position.
Figure 4:
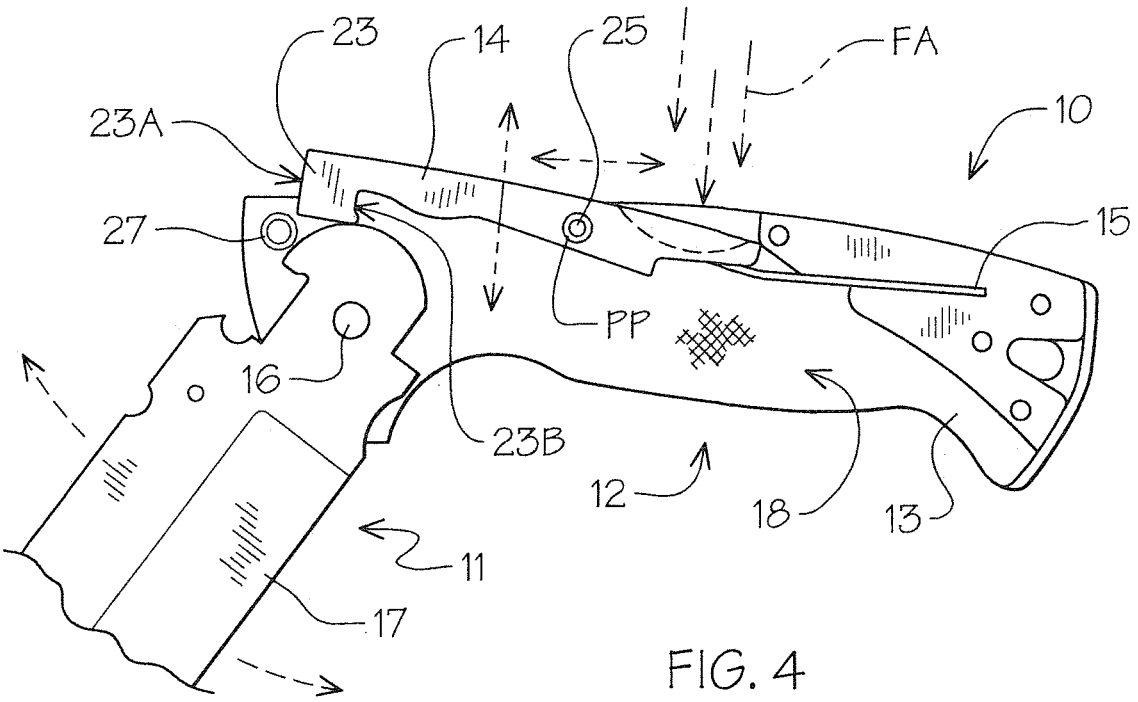
FIG. 4 is a partial side elevational view with portions broken away of the reinforcing pin and locking bar equipped knife in unlocked partial deployed position.
Figure 5:
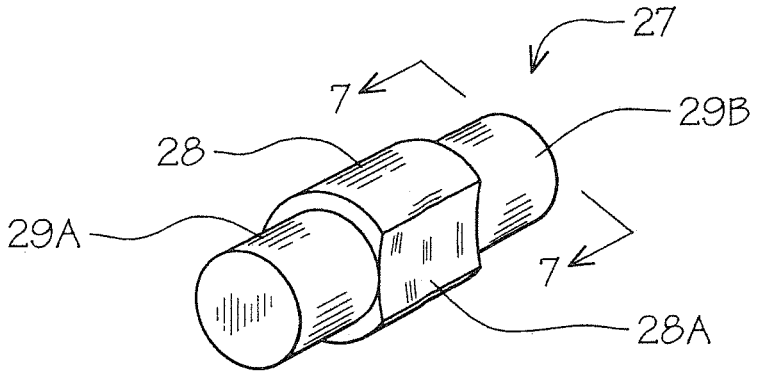
FIG. 5 is an enlarged perspective view of the improved reinforcing pin.
Figure 6:
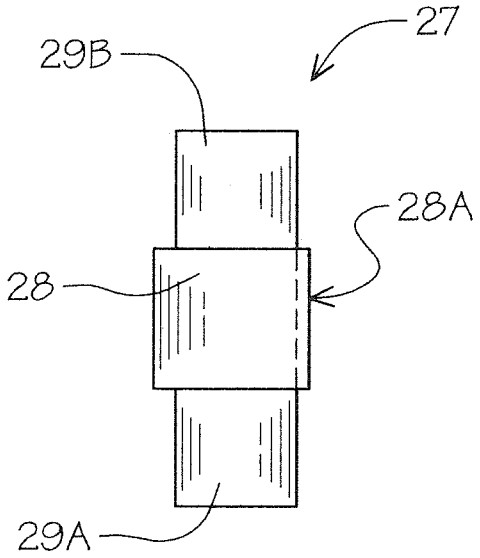
FIG. 6 is a large top plan view thereof.

During the blade 17 deployment from within the handle support portion 12, best seen in FIGS. 3 and 4 of the drawings, the blade shank portion arcuate edge 21 will rotatably engage the notched end portion 23 of the locking bar 14 which is pivotally displaced on the locking bar pivot pin 25 within the bar's enlarged pin receiving opening at 24 against the resilient spring bar 15. The locking bar 14 end portion's contoured end surfaces 23A and inner surface 23B will thereby registerably engage respectively against the corresponding safety reinforcement pin relief surface 28A and blade shank hook surface 22 as seen in FIG. 1 of the drawings. The locking bar contoured engagement surface 23A and spaced inner engagement surface 23B are of a co-parallel arcuate angular inclination to one another as hereinbefore described.

To unlock and close the folding knife 10 of the invention, the user, not shown, applied force is applied to the lock bar 14 indicated by force arrow FA position in FIGS. 1 and 4 of the drawings repositioning the effective lock bar pivot point PP within the enlarged annular opening 24 as seen graphically in FIG. 8 of the drawings. This pivot point PP re-orientation on multiple axis allows clearance needed in respect to the notch bars end portion 23 surface to disengage as indicated in broken lines in FIGS. 1 and 4 of the drawings.

It will be seen that with the modified safety reinforcement pin 27 and repositional pivot point of the lock bar 14 in both longitudinal and vertical axis imparted by the lock bar's fixed pivot pin 25 within the enlarged annular opening 24 as hereinbefore illustrated and described that an improved and enhanced locking mechanism has been illustrated and described and it will be apparent to those skilled in the art that various changes and modification may be made therein without departing from the spirit of the invention. Therefore, I claim:

The invention claimed is:

1. An improvement to a folding knife comprising an elongated handle with an elongated knife blade pivotally secured thereto for movement of the knife blade from a first closed position within said handle to a second locked open position extending from said handle, said knife blade having an elongated sharp edge portion and a shank end portion having a shank hook surface thereon and positioned within said handle portion, a spring urged locking bar having a notched end portion with a contoured end portion pivotally positioned within said handle portion and selectively engageable with said shank hook surface for retaining said knife blade in the second locked open position, a cylindrical reinforcement pin registerably positioned between said locking bar and said shank end portion of said blade, said cylindrical reinforcement pin having a concave contoured relief thereon registerable with said contoured end portion of said locking bar, an enlarged annular opening in said locking bar about a fixed pivot pin, said locking bar adjustably positioned about said fixed pivot pin in both longitudinal and vertical axis.

2. The improvement to the folding knife set forth in claim 1 wherein said shank hook surface is selectively registerable with said corresponding notched end portion on said locking bar.

3. The improvement to the folding knife set forth in claim 2 wherein said cylindrical reinforcement pin in said locked open position is registerable with said shank in both horizontal and vertical face planes in relation to the longitudinal axis of said blade.

4. The improvement to the folding knife set forth in claim 1 wherein said cylindrical reinforcement pin is secured within said handle frame by axially aligned oppositely disposed lugs extending from said cylindrical reinforcement pin.

5. The improvement to the folding knife set forth in claim 4 wherein said axially aligned oppositely disposed extending mounting lugs therefrom are of a reduced diameter.

6. The improvement to the folding knife set forth in claim 5 wherein said concave contoured relief of said cylindrical reinforcement pin extends to a depth equal to the diameter of said cylindrical reinforcement pin's mounting lugs.

7. The improvement to the folding knife set forth in claim 1 wherein said concave contoured relief of said cylindrical reinforcement pin is in aligned engaged relation with said contoured end portion of said locking bar.

8. The improvement to the folding knife set forth in claim 1 wherein said locking bar is pivotally positioned from a first locked position engaging at a contoured arcuate end edge of said shank end portion and said concave contoured relief of said cylindrical reinforcement pin to a second unlocked position engaging said shank end portion.

9. The improvement to the folding knife set forth in claim 1 wherein said adjustability of said locking bar about said fixed pivot pin is of a multiple axis orientation.

10. The improvement to the folding knife set forth in claim 1 wherein said adjustability of said locking bar about said fixed pivot pin is dependent on co-parallel arcuate angular inclination of said notched end portion of said locking bar and said shank hook surface of said shank portion.

* * * * *